US011135704B2

(12) United States Patent
Liau

(10) Patent No.: US 11,135,704 B2
(45) Date of Patent: Oct. 5, 2021

(54) WRENCH WTH TWO CLAMPING PARTS

(71) Applicant: Jia-Guann Liau, Taichung (TW)

(72) Inventor: Jia-Guann Liau, Taichung (TW)

( * ) Notice: Subject to any disclaimer, the term of this patent is extended or adjusted under 35 U.S.C. 154(b) by 276 days.

(21) Appl. No.: 16/186,599

(22) Filed: Nov. 12, 2018

(65) Prior Publication Data

US 2020/0147764 A1 May 14, 2020

(51) Int. Cl.
*B25B 13/30* (2006.01)

(52) U.S. Cl.
CPC ..... *B25B 13/30* (2013.01)

(58) Field of Classification Search
None
See application file for complete search history.

(56) References Cited

U.S. PATENT DOCUMENTS 1,454,333 A * 5/1923 Ochoa ..... B25B 13/12 81/127
5,582,083 A * 12/1996 Baker ..... B25B 13/08 81/119
2011/0239830 A1 10/2011 Abel
2011/0265613 A1* 11/2011 Hu ..... B25B 13/46 81/179

* cited by examiner

*Primary Examiner* — Brian D Keller

(57) ABSTRACT

A wrench includes a first part and a second part which is overlapped on the first part and is pivotable relative to the first part. The first part has a first clamping space and the second part has a second clamping space which is located corresponding to the first clamping space. The first clamping space is defined by two first jaws. The second clamping space is defined by two second jaws. When an object is clamped by the first and second parts, the second part is able to be pivoted an angle relative to the first part to allow the object to be firmly clamped by the first and second parts.

8 Claims, 13 Drawing Sheets

WRENCH WTH TWO CLAMPING PARTS

BACKGROUND OF THE INVENTION

1. Fields of the Invention

The present invention relates to a wrench, and more particularly, to a wrench with two clamping parts which are pivotable relative to each other so as to firmly clamp an object.

2. Descriptions of Related Art

The conventional wrench such as disclosed in U.S. Pat. No. 8,459,153, discloses an inward opening that has a multi-point configuration for partially-surrounding engagement in a torque-transmitting manner on a polygonal profile of a nut or a bolt head. A radial jaw opening is associated with the inward opening and at least two corners of the multi-point configuration each have a stop for a portion of an end face of the polygonal profile. In order to extend the range of use of the wrench, the jaw opening has oppositely-disposed jaw cheeks as the opening of an open-end wrench for torque-transmitting engagement on the polygonal profile, the jaw cheeks extending over the corners of the multi-point configuration on only one wide face of the wrench.

However, when the jaw portions or the multiple-point configurations clamp and rotate the bolt head, there is a gap formed between the jaw portions or the multiple-point configurations clamp and rotate the bolt head.

The steel plate is fixed to the head so that the wrench can only be operated in two ways to clamp the bolt head.

When the bolt head is rounded, the jaw portions or the multiple-point configurations are not able to well clamp and rotate the bolt head.

The present invention is intended to provide a wrench that includes two clamping parts so as to firmly clamp the object and the drawbacks mentioned above are removed.

SUMMARY OF THE INVENTION

The present invention relates to a wrench and comprises a first part and a second part which is overlapped on the first part and is pivotable relative to the first part. The first part has a first clamping space and the second part has a second clamping space which is located corresponding to the first clamping space. The first clamping space is defined by two first jaws. The second clamping space is defined by two second jaws. When an object is clamped by the first and second parts, the second part is able to be pivoted an angle relative to the first part to eliminate the gap between the wrench and the object, and the object is firmly clamped by the first and second parts.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
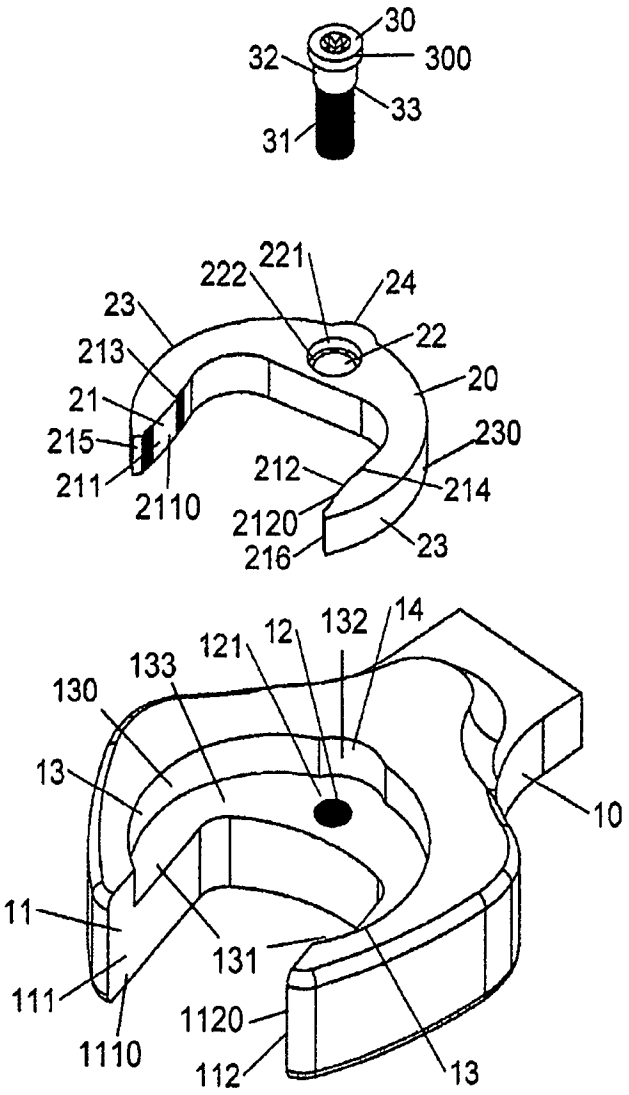
FIG. 1 is an exploded view of the wrench of the present invention.
Figure 3:
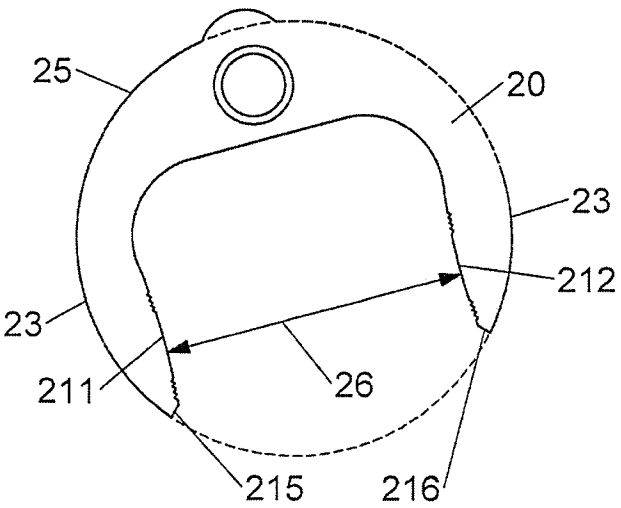
FIG. 3 is a top view of the second part of the wrench of the present invention.
Figure 2:
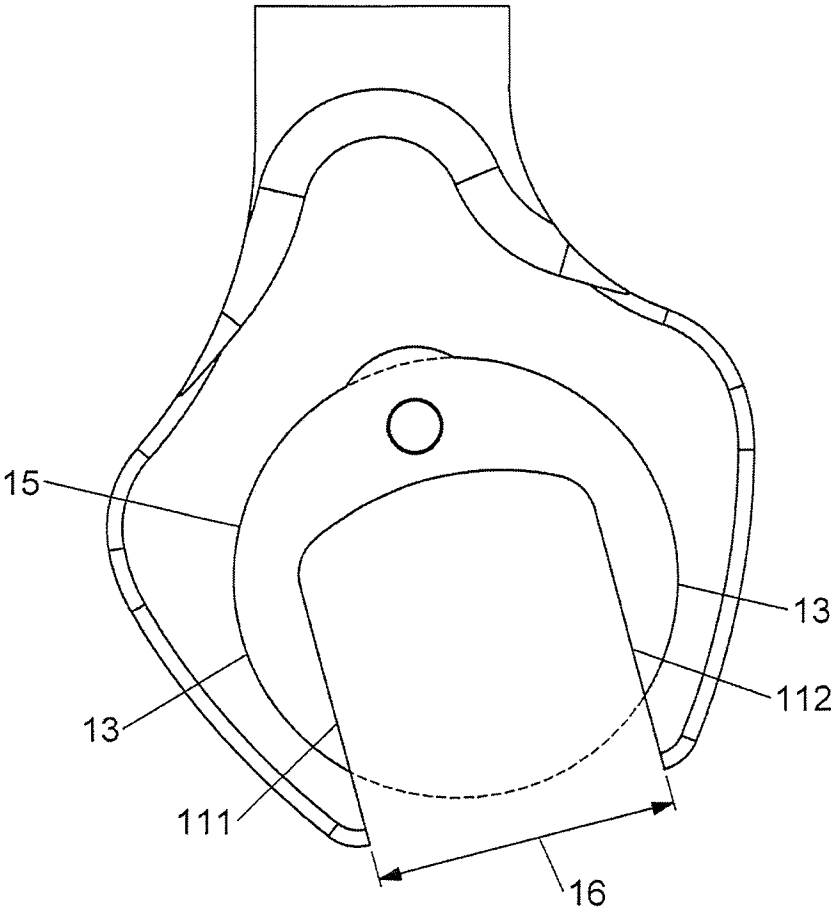
FIG. 2 is a top view of the first part of the wrench of the present invention.

Referring to FIGS. 1 to 3, the wrench of the present invention comprises a first part 10, a second part 20 and a locking member 30. The first part 10 has a first clamping space 11 defined in one end thereof, and the first clamping space 11 is defined by two first jaws 111, 112. The first clamping space is for receiving a hexagonal object 50. The hexagonal object 50 has opposed a first side 51 and a second side 52, and the first side 51 and the second side 52 are parallel to each other. Each of the first jaws 111, 112 has a flat face 1110, 1120 and the two flat faces 1110, 1120 of the first jaws 111, 112 face to each other for contacting the first side 51 and the second side 52 of the hexagonal object 50 respectively. A threaded hole 12 is defined in the first part 10 and includes a contact portion 121 formed at an end of the threaded hole 12. A curved recessed area 130 is formed in the top of the first clamping space 11 and includes a recess 14 which is recessed from a middle wall 132 of the curved recessed area 130 and located between two inner walls 13. The two inner walls 13 extend from two ends of the curved recessed area 130 respectively and two open spaces 131 are defined at distal ends of the two inner walls 13 respectively. The two open spaces 131 are located on and opened to the two flat faces 1110, 1120 of the two first jaws 111, 112 respectively. The recess 14 is a curved recess. The two inner walls 13 are curved faces and simultaneously located along a first circle 15. A minimum first distance 16 is formed between the two flat faces 1110, 1120 of the two first jaws 111, 112.

Figure 4:
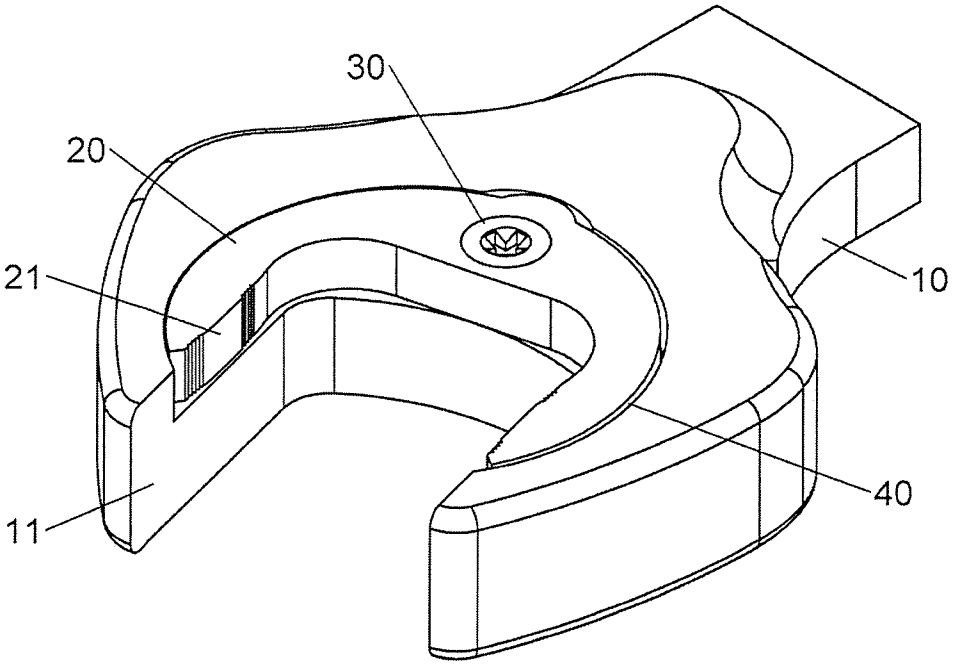
FIG. 4 is a perspective view to show the wrench of the present invention.

The second part 20 is overlapped to the top of the first part 10 and pivotably connected to the first part 10. The second part 20 is located in the curved recessed area 130. The second part 20 has a second clamping space 21 which is communicated to the first clamping space 11. The second clamping space 21 is defined by two second jaws 211, 212. The two second jaws 211, 212 are located in the two open spaces 131 of the two first jaws 111, 112. Each of the second jaws 211, 212 has a protruded face 2110, 2120 and the two protruded faces 2110, 2120 of the second jaws 211, 212 face to each other correspondingly and located in the two open spaces 131 correspondingly for contacting the first side 51 and the second side 52 of the object 50. The second jaw 211 includes two first toothed faces 213 which are spaced from each other and located at two ends of the protruded face 2110 for respectively contacting the first side 51 of the hexagonal object 50. The second jaws 212 includes two second toothed faces 214 which are spaced from each other and located at two ends of the protruded face 2120 for respectively contacting the second side 52 of the hexagonal object 50. The two first toothed faces 213 face to the two second toothed faces 214 correspondingly. One of the second jaws 211 includes a first inclined face 215 formed at the distal end thereof and the other one of the second jaws 211 includes a second inclined faces 216 formed at the distal end thereof, and the first inclined face 215 and the second inclined face 216 are inclined with respect to each other. The second part 20 has a through hole 22 which includes an enlarged receiving room 221 formed in the top end thereof, and a flange 222 extends from the lower end thereof. The diameter of the enlarged receiving room 221 is larger than that of the through hole 22. The second part 20 has a curved outer periphery 230 and includes a protrusion 24 which is located between two outer walls 23 of the curved outer periphery 230. Two outer walls 23 are for contacting the two inner walls 13 correspondingly. The two outer walls 23 are curved faces and simultaneously located along a second circle 25. The second part 20 is pivotably located within the curved recessed area 130. The two inner walls 13 and the protrusion 24 restrict a maximum angle that the second part 20 is pivoted relative to the first part 10. The minimum distance between the two second jaws 211, 212 is defined as a second distance 26. The diameter of the second circle 25 is smaller than that of the first circle 15. As shown in FIG. 4, a first gap 40 is formed between the inner walls 13 and the outer walls 23.

The first distance 16 is a maximum allowable value relative to a DIN standard size between the two first jaws 112, and the second distance 26 is a minimum allowable value relative to the DIN standard size between the two second jaws 212. For example, assume that the standard size is 19 mm, according to DIN standard size, the first distance 16 is 19.36 mm and the second distance 26 is 19.06 mm. Alternatively, the first distance 16 is a minimum allowable value relative to the DIN standard size between the two first jaws 112, and the second distance 26 is a maximum allowable value relative to the DIN standard size between the two second jaws 212. Alternatively, the first distance 16 is close to the second distance 26, or the first distance 16 is equal to the second distance 26.

Figure 5:
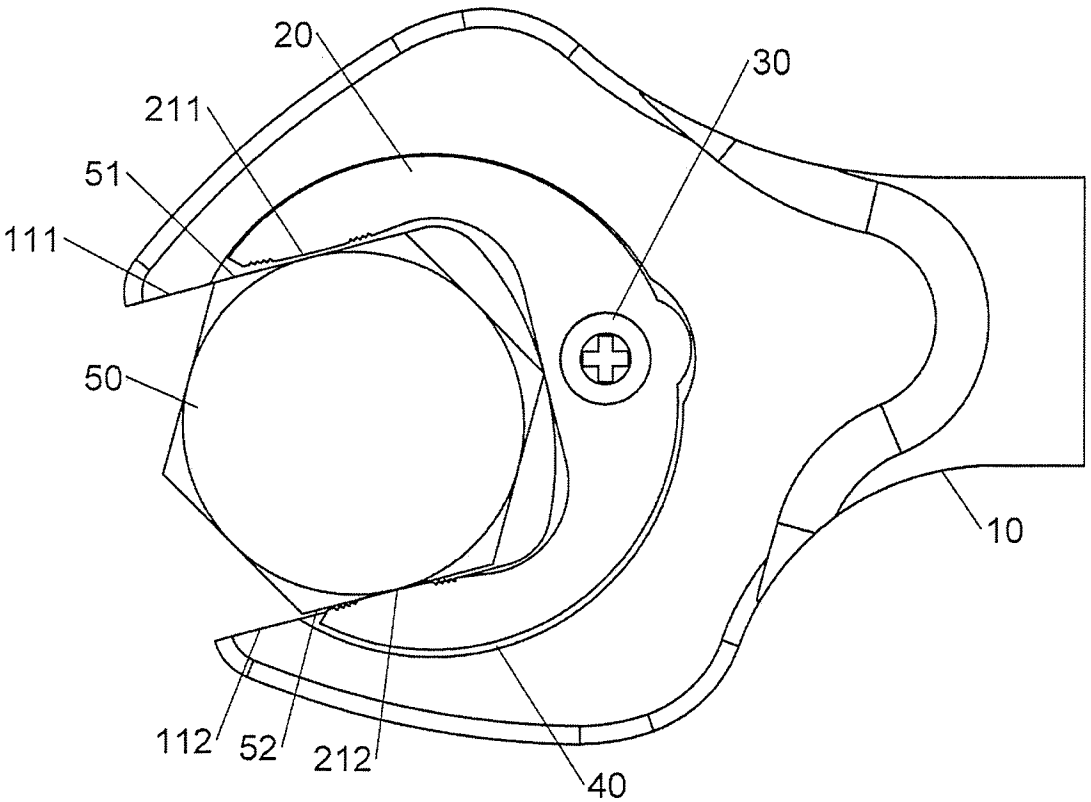
FIG. 5 is a top view to show the first operative status of the wrench of the present invention.

The locking member 30 extends through the through hole 22 and is connected to the threaded hole 12 to pivotably connect the first part 10 to the second part 20. The locking member 30 includes a head 300, a threaded shank 31 and an intermediate portion 32 that is formed between the head 300 and the threaded shank 31. The diameter of the intermediate portion 32 is larger than that of the threaded shank 31 so as to form a shoulder 33 between the intermediate portion 32 and the threaded shank 31. The intermediate portion 32 of the locking member 30 is located in the through hole 22 and the threaded shank 31 is threadedly connected to the threaded hole 12. The shoulder 33 contacts the contact portion 121 of the threaded hole 12. The head 300 is located in the enlarged receiving room 221. When an object 50 is clamped by the first and second parts 10, 20 as shown in FIG. 5. When the wrench and the object 50 are rotated clockwise, the first and the second sides 51, 52 of the object 50 are respectively located within the first clamping space 11 and the second clamping space 21. The first side 51 contacts the first jaw 111, and there is a gap formed between the second side 52 and the other first jaw 112. The second part 20 is pivoted an angle about the locking member 30 relative to the first part 10, one of the outer walls 23 contacts one of the inner walls 13, and the other one of the outer walls 23 is moved away from the other one of the inner walls 13. The second jaw 212 of the second part 20 contacts the second side 52 so that the first and second sides 51, 52 of the object 50 are respectively in contact with the first and second jaws 111, 112 without the gap mentioned above. Therefore, the object 50 can be firmly clamped and rotated. The contact portion 121 is a flat surface and located on a flat bottom 133 of the curved recessed area 130, and the flat surface and the flat bottom 133 are located on a same plane.

Figure 6:
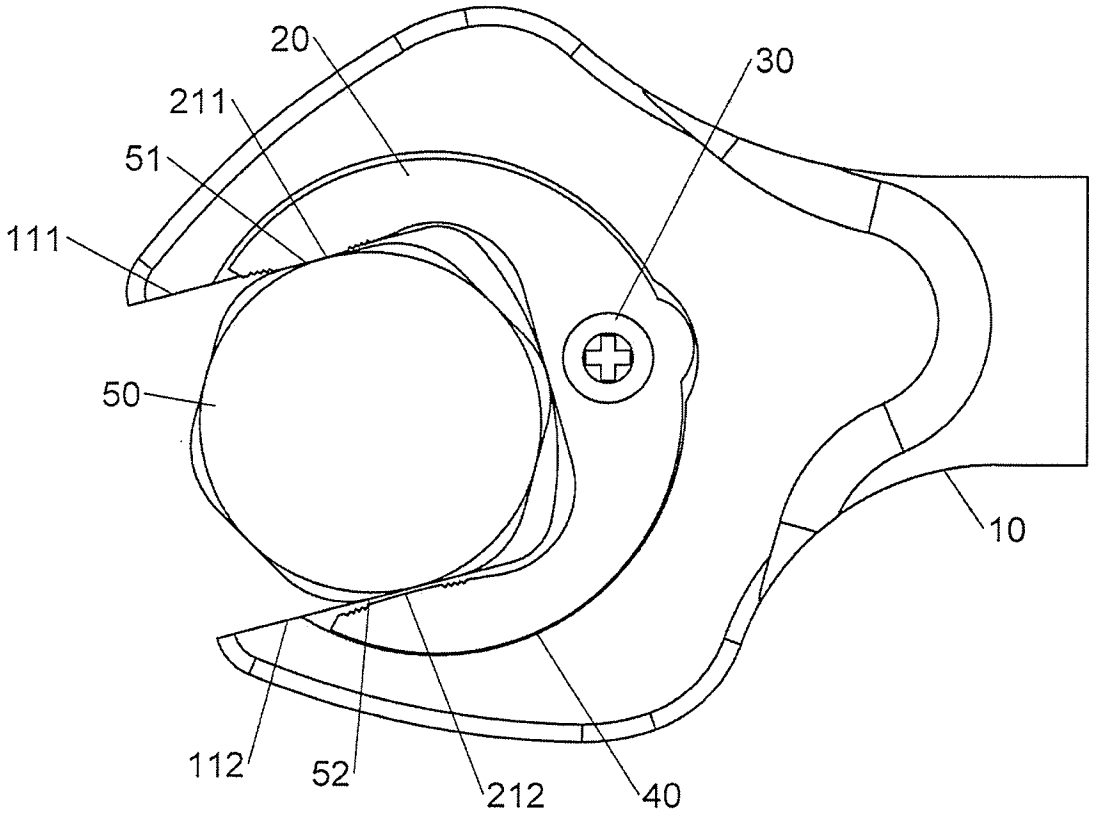
FIG. 6 is a top view to show the second operative status of the wrench of the present invention.

As shown in FIG. 6, when the object 5 is rounded, and the wrench and the object are rotated counter clockwise, the second side 52 of the object 50 contacts the first jaw 112, and a gap is formed between the first side 51 of the object 50 and the first jaw 111. When the second part 20 is pivoted an angle, the second jaw 211 contacts the first side 51 so that the gap mentioned above is disappeared, and the object 50 can be firmly clamped and rotated.

Figure 7:
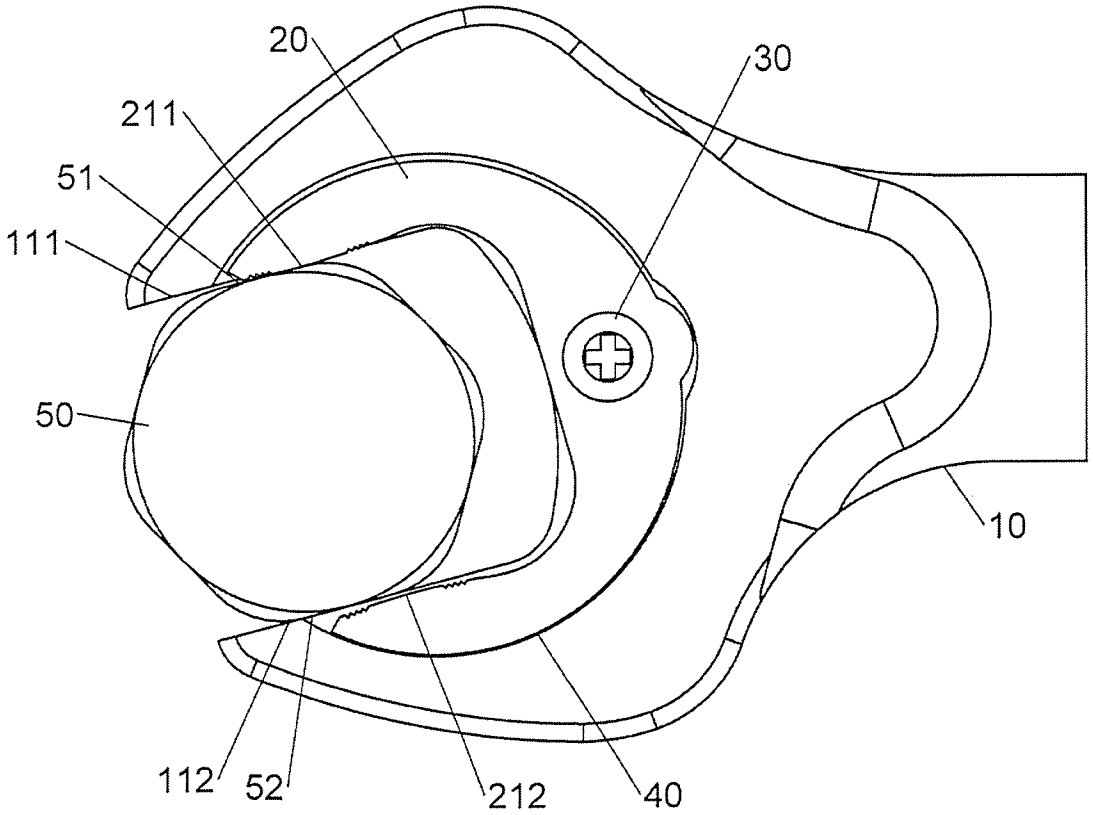
FIG. 7 is a top view to show the third operative status of the wrench of the present invention.

As shown in FIG. 7, when the object 5 is rounded, and the wrench and the object are rotated counter clockwise, the object 50 moves away from the wrench slightly and is still located within the first and second clamping spaces 11, 21. There is a gap formed between the first side 51 of the object 50 and the first jaw 111, and the second side 52 of the object 50 does not contact the first jaw 112. The first toothed faces 213 contact the first side 51 so that the object 50 can be firmly clamped and rotated.

Figure 8:
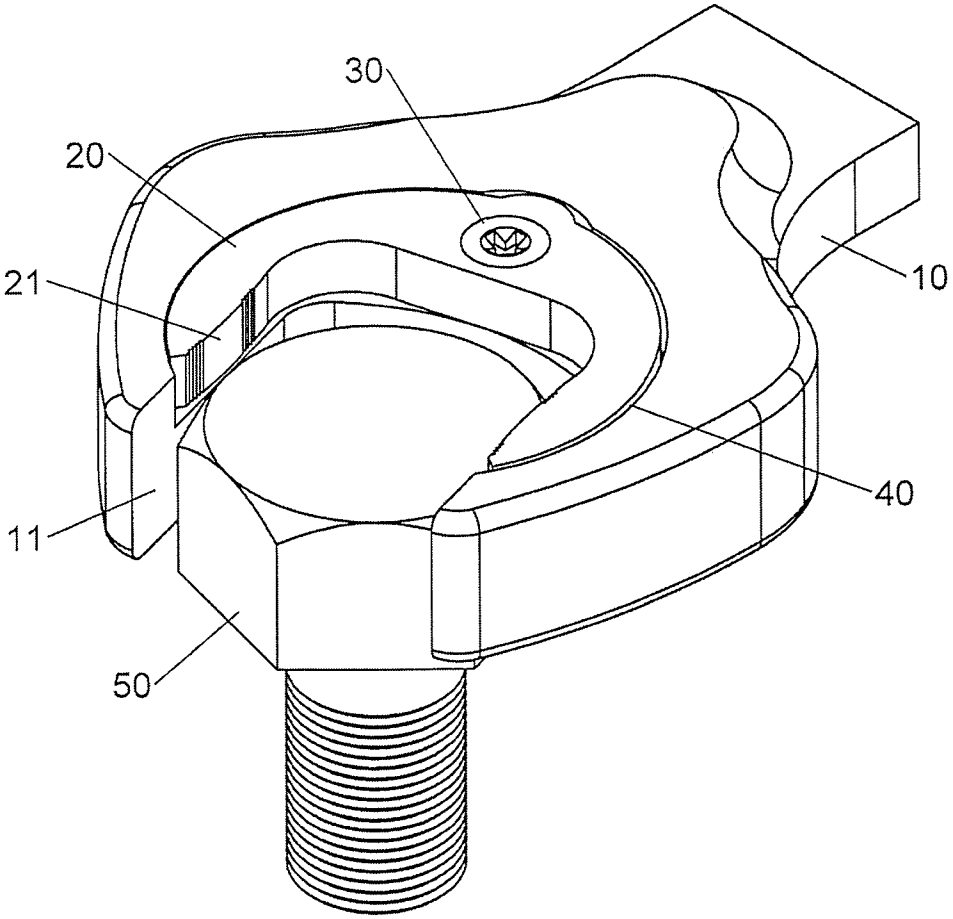
FIG. 8 is a top view to show the fourth operative status of the wrench of the present invention.

FIG. 8 shows that the object 50 is located only in the first clamping space 11.

Figure 9:
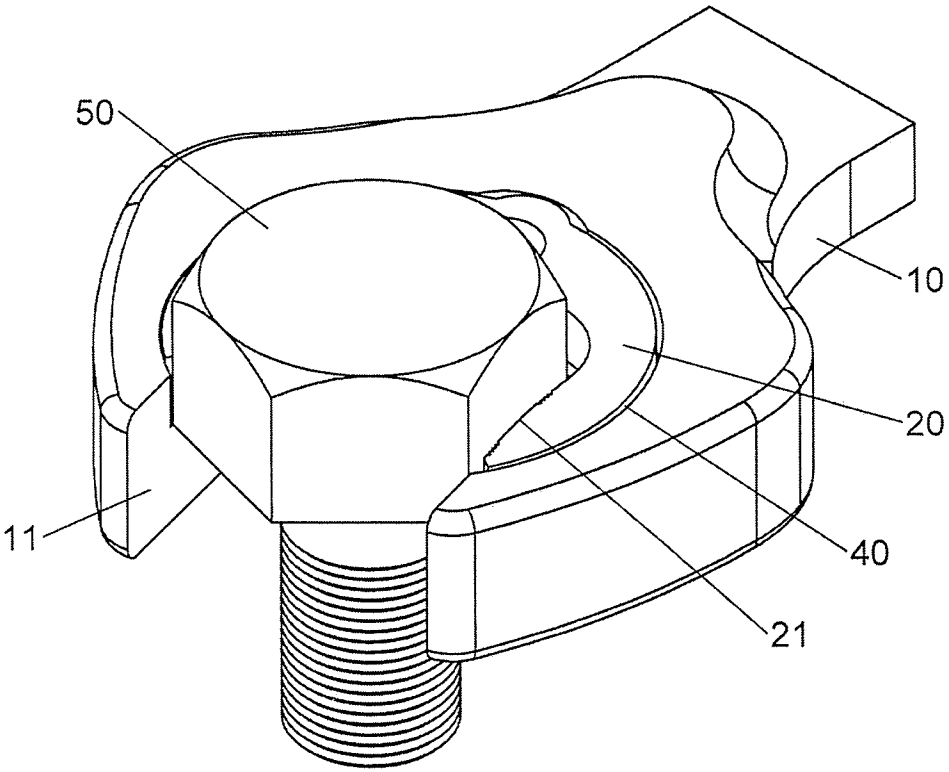
FIG. 9 is a top view to show the fifth operative status of the wrench of the present invention.

FIG. 9 shows that the object 50 is located only in the second clamping space 21, and the top head of the object 50 protrudes beyond the first part 10. The object 50 can also be rotated by the wrench.

Figure 10:
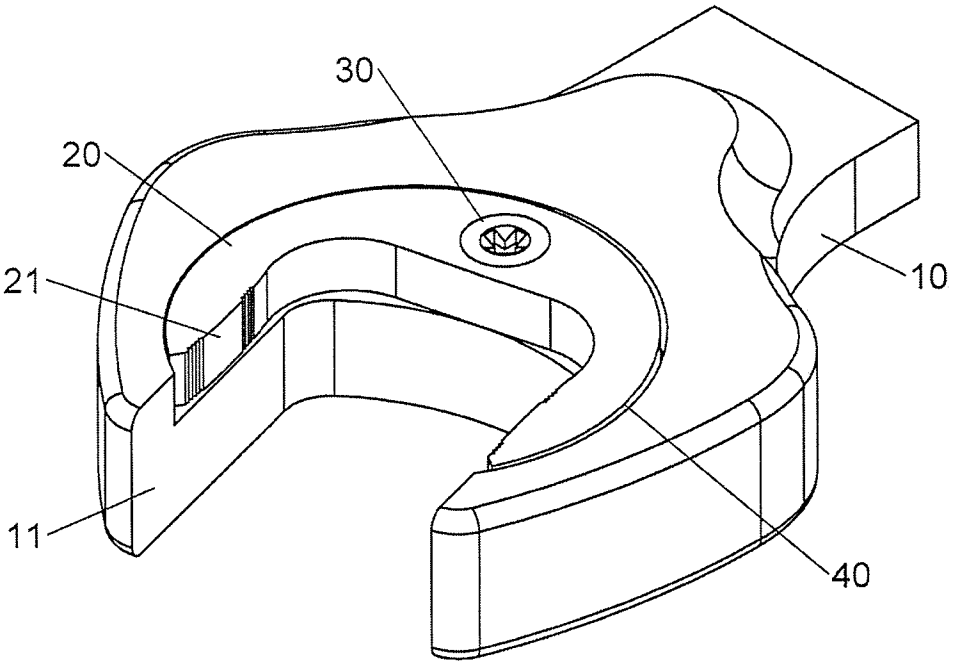
FIG. 10 is a perspective view to show the second embodiment of the wrench of the present invention.

FIG. 10 shows that the first part 10 does not have the recess 14, and the second part 20 does not have the protrusion 24.

Figure 11:
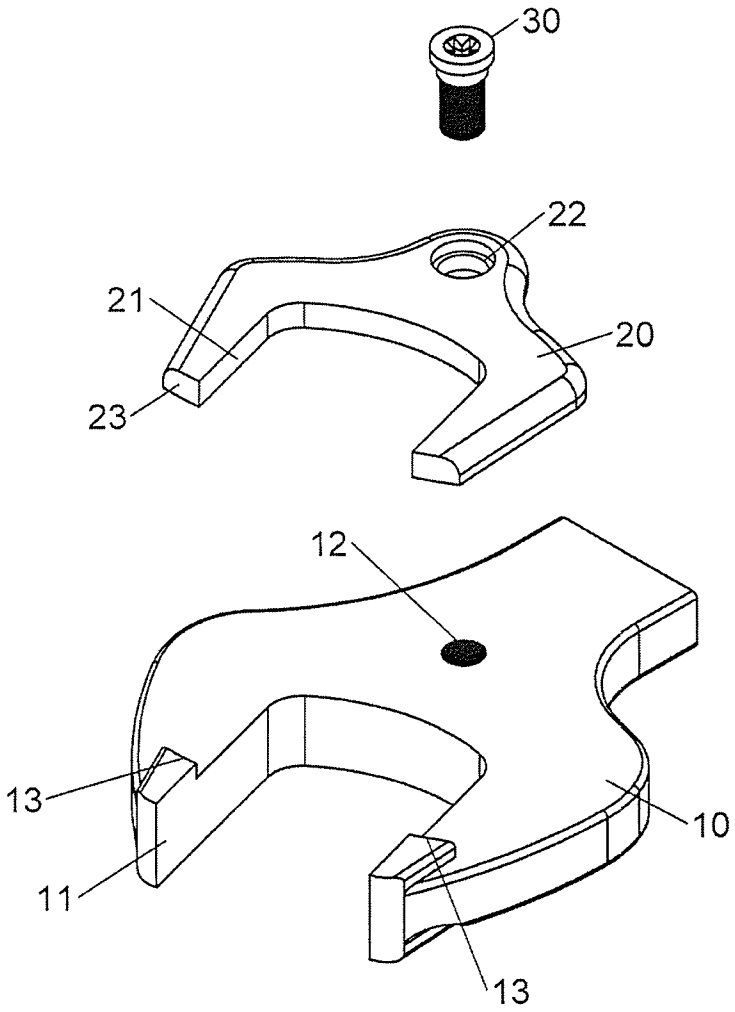
FIG. 11 is an exploded view of the third embodiment of the wrench of the present invention.
Figure 12:
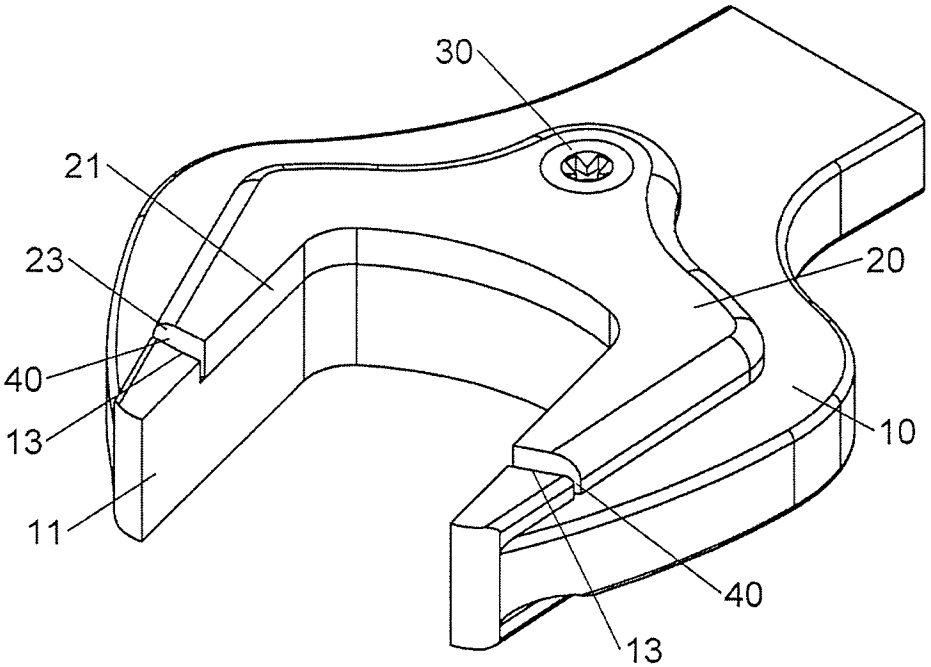
FIG. 12 is a perspective view to show the third embodiment of the wrench of the present invention.

FIGS. 11 and 12 show that each of the two inner walls 13 is a flat face and located at the distal end of the first part 10 corresponding thereto. The first part 10 does not have the recess 14. Each of the two outer walls 23 is a flat face and located at the distal end of the second part 20 corresponding thereto. The second part 20 does not have the first and second toothed faces 213, 214, the first inclined face 215, the second inclined face 216 and the protrusion 24. When one of the outer walls 23 contacts one of the inner walls 13, the other one of the outer walls 23 is moved away from the other one of the inner walls 13.

Figure 13:
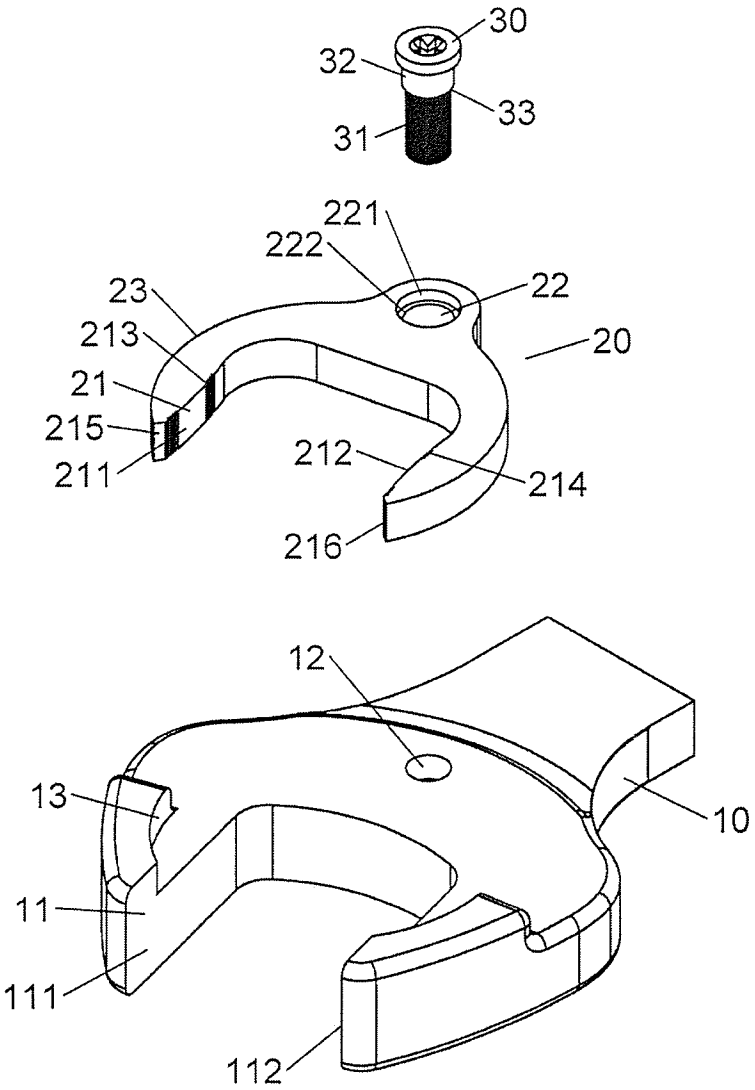
FIG. 13 is an exploded view of the fourth embodiment of the wrench of the present invention.
Figure 14:
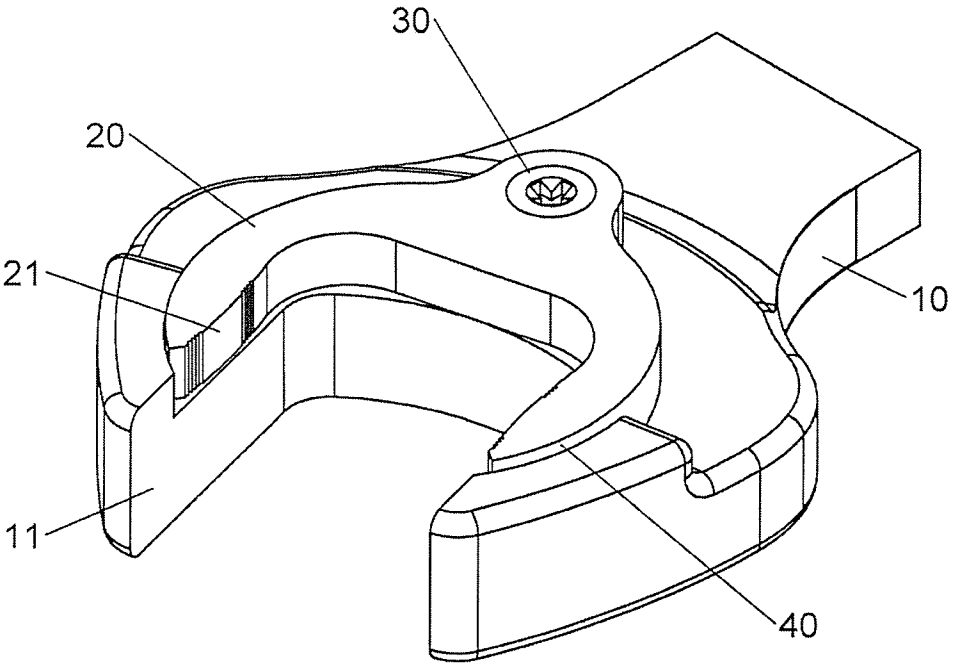
FIG. 14 is a perspective view to show the fourth embodiment of the wrench of the present invention.

FIGS. 13 and 14 show that first part 10 does not have the recess 14 and the second part 20 does not have the protrusion 24.

The advantages are that the second part 20 is overlapped to the top of the first part 10 and pivotably connected to the first part 10. The object 50 is clamped by both of the first and second parts 10, 20 so as to be firmly rotated.

When the second part 20 is pivoted relative to the first part 10, the outer walls 23 contact the inner walls 13, and the inner walls 13 and the recess 14 restrict the maximum angle that the second part 20 is pivoted relative to the first part 10.

The object 50 are protected from being worn out by the first and second parts 10, 20.

As shown in FIGS. 5 to 9, there are at least five operational statuses can be used of the wrench.

The object 50 is clamped by the first and second clamping spaces 11, 21, there is a gap formed between the second side 52 and the first jaw 112. The second part 20 is pivoted an angle about the locking member 30 relative to the first part 10, the first and second sides 51, 52 respectively contact the first and second jaws 111, 212, so that the object 50 can be firmly clamped and rotated.

The shoulder 33 contacts the contact portion 121. The intermediate portion 32 is thicker than the second part 20, when the locking member 30 extends through the through hole 22 and is connected to the threaded hole 12, the second part 20 is pivotable.

While we have shown and described the embodiment in accordance with the present invention, it should be clear to those skilled in the art that further embodiments may be made without departing from the scope of the present invention.

What is claimed is:

1. A wrench comprising:

a first part having a first clamping space defined in one end thereof, the first clamping space defined by two first jaws, the first clamping space being for receiving a hexagonal object; the hexagonal object having opposed a first side and a second side, and the first side and the second side being parallel to each other; the two first jaws having a flat face respectively and the two flat faces of the two first jaws facing to each other for contacting the first side and the second side of the hexagonal object respectively, a threaded hole defined in the first part and having a contact portion formed at an end of the threaded hole, a curved recessed area formed in a top of the first clamping space, two inner walls extending from two ends of the curved recessed area respectively and two open spaces being defined at distal ends of the two inner walls respectively; the two open spaces being located on and opened to the two flat faces of the two first jaws respectively, a minimum first distance formed between the two flat faces of the two first jaws;

a second part pivotably connected to the first part and located in the curved recessed area, the second part having a second clamping space which is communicated to the first clamping space, the second clamping space defined by two second jaws, the two second jaws located in the two open spaces of the two first jaws, each of the second jaws have a protruded face, the two protruded faces of the second jaws facing to each other and located in the two open spaces for contacting the first side and the second side of the object respectively, the second part having a through hole which includes an enlarged receiving room formed in a top end thereof, and a flange extending from a lower end thereof, the second part having two outer walls for contacting the two inner walls correspondingly, a minimum distance between the two second jaws being defined as a second distance, a first gap formed between the inner walls and the outer walls; the two inner walls each being a curved face and simultaneously located along a first circle, the two outer walls each being a curved face and simultaneously located along a second circle, a diameter of the second circle being smaller than that of the first circle, and a locking member extending through the through hole and connected to the threaded hole to pivotably connect the first part to the second part, the locking member including a head, a threaded shank and an intermediate portion that is formed between the head and the threaded shank, a diameter of the intermediate portion being larger than that of the threaded shank so as to form a shoulder between the intermediate portion and the threaded shank, the intermediate portion of the locking member located in the through hole and the threaded shank threadedly connected to the threaded hole, the shoulder contacting the contact portion of the threaded hole, the head is located in the enlarged receiving room, wherein when the second part is pivoted an angle about the locking member relative to the first part, one of the outer walls contacts one of the inner walls, and the other one of the outer walls is moved away from the other one of the inner walls.

2. The wrench as claimed in claim 1, wherein the first part includes a recess which is recessed from a middle wall of the curved recessed area and located between the two inner walls, the second part includes a protrusion which is engaged with the recess, the second part is pivoted relative to the first part, the two inner walls and the protrusion restrict a maximum angle that the second part is pivoted relative to the first part.

3. The wrench as claimed in claim 1, wherein one of the second jaws includes two first toothed faces which are spaced from each other and located at two ends of the protruded face for respectively contacting the first side of the hexagonal object, the other one of the second jaws includes two second toothed faces which are spaced from each other and located at two ends of the protruded face for respectively contacting the second side of the hexagonal object, the two first toothed faces face to the two second toothed faces correspondingly.

4. The wrench as claimed in claim 1, wherein one of the second jaws includes a first inclined face formed at a distal end thereof, the other one of the second jaws includes a second inclined face formed at a distal end thereof, the first inclined face and the second inclined face are inclined with respect to each other.

5. The wrench as claimed in claim 1, wherein the contact portion is a flat surface and located on a flat bottom of the curved recessed area, and the flat surface and the flat bottom are located on a same plane.

6. A wrench comprising:

a first part having a first clamping space defined in one end thereof, the first clamping space defined by two first jaws, the first clamping space being for receiving a hexagonal object; the hexagonal object having opposed a first side and a second side, and the first side and the second side being parallel to each other; the two first jaws having a flat face respectively and the two flat faces of the two first jaws facing to each other for contacting the first side and the second side of the hexagonal object respectively, a threaded hole defined in the first part and having a contact portion formed at an end of the threaded hole, a curved recessed area formed in a top of the first clamping space, two inner walls extending from two ends of the curved recessed area respectively and two open spaces being defined at distal ends of the two inner walls respectively; the two open spaces being located on and opened to the two flat faces of the two first jaws respectively, a minimum first distance formed between the two flat faces of the two first jaws;

a second part pivotably connected to the first part and located in the curved recessed area, the second part having a second clamping space which is communicated to the first clamping space, the second clamping space defined by two second jaws, the two second jaws located in the two open spaces of the two first jaws, each of the second jaws have a protruded face, the two protruded faces of the second jaws facing to each other and located in the two open spaces for contacting the first side and the second side of the object respectively, the second part having a through hole which includes an enlarged receiving room formed in a top end thereof, and a flange extending from a lower end thereof, the second part having two outer walls for contacting the two inner walls correspondingly, a minimum distance between the two second jaws being defined as a second distance, a first gap formed between the inner walls and the outer walls; each of the two inner walls being a flat face, each of the two outer walls being a flat face, and a locking member extending through the through hole and connected to the threaded hole to pivotably connect the first part to the second part, the locking member including a head, a threaded shank and an intermediate portion that is formed between the head and the threaded shank, a diameter of the intermediate portion being larger than that of the threaded shank so as to form a shoulder between the intermediate portion and the threaded shank, the intermediate portion of the locking member located in the through hole and the threaded shank threadedly connected to the threaded hole, the shoulder contacting the contact portion of the threaded hole, the head is located in the enlarged receiving room, wherein when the second part is pivoted an angle about the locking member relative to the first part, one of the outer walls contacts one of the inner walls, and the other one of the outer walls is moved away from the other one of the inner walls.

7. The wrench as claimed in claim 6, wherein one of the second jaws includes two first toothed faces which are spaced from each other and located at two ends of the protruded face of the one of the second jaws for respectively contacting the first side of the hexagonal object, the other one of the second jaws includes two second toothed faces which are spaced from each other and located at two ends of the protruded face of the other one of the second jaws for respectively contacting the second side of the hexagonal object, the two first toothed faces face to the two second toothed faces correspondingly.

8. The wrench as claimed in claim 6, wherein the contact portion is a flat surface and located on a flat bottom of the curved recessed area, and the flat surface and the flat bottom are located on a same plane.

* * * * *